US011186974B2

(12) United States Patent
Russell et al.

(10) Patent No.: US 11,186,974 B2
(45) Date of Patent: Nov. 30, 2021

(54) FLUIDIC FAUCET SPRAY FACE AND SPRAY GENERATION METHOD

(71) Applicant: DLHBOWLES, INC., Canton, OH (US)

(72) Inventors: Gregory A. Russell, Catonsville, MD (US); Russell Hester, Odenston, MD (US); Benjamin D. Hasday, Baltimore, MD (US)

(73) Assignee: DLHBOWLES, INC., Canton, OH (US)

( * ) Notice: Subject to any disclaimer, the term of this patent is extended or adjusted under 35 U.S.C. 154(b) by 32 days.

(21) Appl. No.: 15/751,197

(22) PCT Filed: Aug. 11, 2016

(86) PCT No.: PCT/US2016/046578
§ 371 (c)(1),
(2) Date: Feb. 8, 2018

(87) PCT Pub. No.: WO2017/027720
PCT Pub. Date: Feb. 16, 2017

(65) Prior Publication Data

US 2018/0238032 A1 Aug. 23, 2018

Related U.S. Application Data

(60) Provisional application No. 62/203,579, filed on Aug. 11, 2015.

(51) Int. Cl.
*B05B 1/08* (2006.01)
*E03C 1/084* (2006.01)
(Continued)

(52) U.S. Cl.
CPC ..... *E03C 1/084* (2013.01); *B05B 1/08* (2013.01); *B05B 1/14* (2013.01); *B05B 1/30* (2013.01);
(Continued)

(58) Field of Classification Search
CPC ... E03C 1/084; E03C 1/00; B05B 1/08; B05B 1/14; B05B 1/30; B05B 1/18; F15B 15/20
(Continued)

(56) References Cited

U.S. PATENT DOCUMENTS 3,741,481 A 6/1973 Bauer
4,000,857 A 1/1977 Moen
(Continued)

OTHER PUBLICATIONS

Patent Cooperation Treaty (PCT), International Search Report and Written Opinion for Application PCT/US2016/046578 filed Aug. 11, 2016, dated Nov. 16, 2016, International Searching Authority, US.

(Continued)

*Primary Examiner* — Qingzhang Zhou
*Assistant Examiner* — Joel Zhou
(74) *Attorney, Agent, or Firm* — McDonald Hopkins LLC

(57) ABSTRACT

A flow-restricted compound spray generating device 100 includes a spray face member 120B including at least one fluidic circuit oscillator defining geometry 132 including an outlet orifice 138 in the spray face member's central area configured to aim an oscillating spray 300 having a selected oscillating spray thickness distally along a spray axis 112. The spray face member 120B also includes a plurality of non-oscillating (e.g., laminar or jet) spray generating orifices 160B arrayed evenly around the spray face member's periphery to aim a plurality of non-oscillating laminar or jet sprays 302 distally along the spray axis 112 to provide a ring of high velocity streams arrayed around the central oscillat-
(Continued)

ing spray 300 to generate a compound spray 310 with an outflow which has a pleasing spray density with an apparent outflow thickness which is substantially equal to the spout orifice's diameter 320.

16 Claims, 9 Drawing Sheets

(51) Int. Cl.
*E03C 1/00* (2006.01)
*F15B 15/20* (2006.01)
*B05B 1/14* (2006.01)
*B05B 1/30* (2006.01)
*B05B 1/18* (2006.01)

(52) U.S. Cl.
CPC ..... *E03C 1/00* (2013.01); *F15B 15/20* (2013.01); *B05B 1/18* (2013.01)

(58) Field of Classification Search
USPC ..... 239/589.1
See application file for complete search history.

(56) References Cited

U.S. PATENT DOCUMENTS

| | | | | |
|---|---|---|---|---|
| 7,111,800 | B2 | 9/2006 | Berning | |
| 7,114,666 | B2 * | 10/2006 | Luettgen | B05B 1/1654 239/463 |
| 2005/0087633 | A1 * | 4/2005 | Gopalan | B60S 1/52 239/589.1 |
| 2010/0072307 | A1 * | 3/2010 | Hester | B05B 1/14 239/589.1 |
| 2014/0145009 | A1 * | 5/2014 | Hartranft | B05B 1/08 239/302 |
| 2014/0263760 | A1 * | 9/2014 | Hanna | B05B 1/06 239/558 |

OTHER PUBLICATIONS

European Patent Office, Extended Search Report for Application 16835920.6, dated Mar. 18, 2019.

* cited by examiner

FLUIDIC FAUCET SPRAY FACE AND SPRAY GENERATION METHOD

PRIORITY CLAIM AND REFERENCE TO RELATED APPLICATIONS

This application is a 35 U.S.C. 371 national stage filing of PCT Application No. PCT/US2016/046578 filed on Aug. 11, 2016, and entitled "FLUIDIC FAUCET SPRAY FACE AND SPRAY GENERATION METHOD", which claims the priority benefit of commonly owned U.S. provisional patent application No. 62/203,579, filed on Aug. 11, 2015, and entitled "Fluidic Faucet Spray Face and Spray Generation Method", and the entire disclosure thereof is hereby incorporated herein by reference. This application is also related to the following commonly owned patent applications: (a) PCT application no. PCT/US12/34293, filed Apr. 19, 2012 and entitled Cup-shaped Fluidic Circuit, Nozzle Assembly and Method (WIPO Pub WO 2012/145537), and (b) PCT application no. PCT/US14/32286, filed 29 March, 2014, and entitled Cup-shaped Nozzle Assembly with Integral Filter and Alignment Features (WIPO Pub WO/2014/160992), the entire disclosures of which are also hereby incorporated herein by reference.

BACKGROUND OF THE INVENTION

Field of the Invention

The present invention relates generally to nozzle assemblies having flow control or aerator structures of the type commonly used with kitchen and bathroom faucets to conserve water.

Discussion of the Prior Art

Water conservation is becoming an increasingly urgent need and many local, state and federal government agencies have promulgated regulations which restrict water use and specifically water flow rates from faucets and other plumbing fixtures. Plumbing supply companies (e.g. faucet manufacturers), landlords and facilities operators are being forced to design, install and use products which reduce water consumption. Many local municipalities (e.g. Los Angeles, Calif. and New York, N.Y.) have instituted further, stricter limitations on commercial and residential water usage. These local restrictions extend beyond irrigation and toilet flush volumes and have now affected showerheads and faucets. As a result, faucets with excessive flow rates are becoming a source of legal liability. This is a concern for facility operators and landlords because occupants or tenants may decide to remove flow restrictors from faucets to obtain an unrestricted flow.

Faucet flow restricting aerators are usually included in removable inserts in kitchen or bathroom faucets. Aerators transform the water flowing from a faucet or spray head into a homogeneous, low velocity, non-spattering and bubble-softened flow of water. Typical faucet flow restrictors have an aerator housing that is embodied in the form of an insert cartridge inserted into the faucet's outlet. The aerator cartridge typically has a housing with an interior containing a flow-dispersing perforated plate situated at its inflow end and a grid or lattice structure situated downstream of it in the flow direction. This grid or lattice structure can be a metal sieve or screen or can be a plastic grid and it functions as a flow-regulating device that mixes air into the individual streams or water jets issuing from the flow-dispersing perforated plate. In addition to or in lieu of this, at least one grid and/or lattice structure situated downstream of the flow-dispersing perforated plate can also act as a flow straightener whose function is to homogenize the flow of water issuing from the faucet. These prior art flow restricting structures provide reduced flow rates, but the softened, low velocity outflows are typically not satisfying to use.

Typical prior art water saving aerator inserts (see, e.g., Moen's U.S. Pat. No. 4,000,857 and FIG. 1) do not provide pleasing performance for the user, especially if significantly restricted flow is provided. FIG. 1 shows a typical flow restrictive faucet insert assembly or aerator insert used in the prior art, and this figures' insert is described here to provide added background and context. Referring specifically to FIG. 1, a typical (e.g., "flo-control") aerator housing is indicated at 10 and includes an outlet or discharge 12 and an inlet end 14 aligned along a central axis. There are threads 16 at the upstream end of the housing 10 for use in attaching the aerator to a typical faucet or sprayer's spout 18. A seal 19 is positioned between the housing 10 and spout 18. The aerator housing 10 may be formed of a suitable metal, such as brass or may be made of a suitable plastic. The housing 10 may have an integral jet forming partition 20 with a plurality of individual passages 22, arranged in an annular manner, concentric with the central axis of the housing 10. Positioned on the upstream side of the partition 20 and at least partially masking the passages 22, is a pressure-responsive flow control member 24 which may be an O-ring formed of a suitable elastomeric or rubberlike material. The ring 24 is supported by inner and outer walls 26 and 28 which extend upwardly from the upstream side of the partition 20. The inner surface of the outer wall 26 is outwardly curved to provide access to the passages 22. In like manner, the outer surface of inner wall 28 is inwardly curved to provide access to the opposite side of each passage 22. Thus, water flowing from the faucet spout, first passing through a conical screen 38, will reach the flow control member 24, and then flow distally or downwardly past it, both on the inside and the outside, to reach the water passages 22 in the partition 20. The screen 38 may have its outer edges embedded in seal 19. Downstream (flowing from inlet 14 to outlet 12) of the partition 20 is a screen 40 including a pair of spaced screens 42 and 44. The lower screen 44 is positioned on a ledge 46 extending inwardly from screen support 48. The upper screen 42 is positioned upon a circular spacer 50 on the inside surface of the screen support 48. Thus, the screens 42 and 44 are held in spaced relation within the screen support 48. The screen support 48 in turn is positioned within the lower or downstream end of the housing 10 by four outwardly extending projections 52 which snap within a mating groove 54 on the inside surface 56 of the housing 10. The projections 52 may be circumferentially spaced, one from another, to define upwardly-extending air passages 58. Air is drawn from the area outside the bottom of the aerator, upwardly along the passages 58 and then to the space 60 at the downstream side of the jet forming member or partition 20 and above the screen 40.

In operation, water flowing from the faucet's spout will first pass through the conical screen 38 and then through the entrances defined by curved sections 32 and 36 into the water passages 22. After passing through jet forming passages 22, the streams of water will mix with air from passages 58 and then flow through the screen means 40 to provide the conventional aerated discharge or faucet outflow. The pressure-responsive flow control member 24 is formed of a distortable material. Thus, the greater the fluid pressure applied from the spout 18, the greater will be the distortion of the member 24 to restrict the entrances into the water passages 22. Thus, the amount of water that will flow through the aerator is limited by the pressure-responsive flow control member, even though the pressure applied to the aerator may continually increase. There is a maximum amount of water that can be discharged from the aerator, regardless of the pressure applied to it. This has particular advantage both as far as the saving of water, one of our important natural resources, and as far as permitting the user of the faucet to control the total amount of water supplied by the spout. It is not unusual for someone operating a kitchen or bathroom faucet to first turn the faucet to full "on". With the some older aerator designs, this habit often provides more water than necessary or needed and at times would splash the user.

Over-aerated low-flow faucets may successfully provide modest flow rates with non-spattering homogenous outflows, but those gassy, noisy aerated low-velocity outflows are not particularly satisfying to use, in that they do not provide a satisfying and effective spray for washing or rinsing. The prior art's non-aerating flow restrictors are even less satisfying to use, since they typically provide a visibly reduced outflow comprising a few narrow jets of water, and this visibly reduced outflow is obviously going to cause less satisfying outflow performance when using the fixture (e.g., a faucet, when washing or rinsing). Some flow restricting spray inserts have outflow generating faces which use a few laminar jets or concentrated jets to develop enough spray force or energy to clean soap, dirt, food, etc. from a target surface, but flow restricting inserts have fewer, smaller jets. The visibly reduced outflow appears, to the user, to be a few jets or small streams of water flowing from a fixture outlet which is obviously larger in area than the outlflow's apparent size, so users or tenants are tempted to remove those prior art flow restrictors.

There is a need, therefore, for a flow-restricted or water conserving faucet, sprayer or nozzle assembly and spray generation method which overcomes the problems with the prior art and provides acceptably low flow rates when in use, while also providing satisfying and not visibly reduced outflows (e.g., sprays) for washing or rinsing.

OBJECTS AND SUMMARY OF THE INVENTION

Accordingly, it is an object of the present invention to overcome the above mentioned difficulties by providing a flow-restricted or water conserving nozzle assembly adapted for use in a faucet or hand sprayer, and having one or more fluidic oscillating chambers configured within the nozzle assembly to generate oscillating sprays which, when combined with a plurality of conventional (e.g., jet or planar sheet) sprays simultaneously regulate the volume of water passing through the nozzle assembly while providing a satisfying spray for washing and rinsing.

In accordance with the present invention, a nozzle or faucet assembly is configured in a substantially cylindrical housing having an interior volume which supports and provides a fluid supply channel for a spray face member which packages two or more fluidic cup oscillators with interaction chambers adapted to work within a traditional faucet aerator insert's package space for typical kitchen and lavatory faucet flow regulators. In the embodiment of the nozzle assembly described and illustrated in this application, a new structure and method enable a visibly "thick" compound spray which provides a more satisfying outflow and improved cleaning and rinsing at low flow rates. For example, at typical plumbing supply pressures of 10-80 psi and in conjunction with a flow regulating device (like a NeoPerl® regulator) the fluidic geometry in the spray face of the present invention will provide superior rinsing and cleaning at lower flow rates (e.g., between 0.15 GPM and 0.70 GPM) compared to more generic aerated, laminar or needle jet spray faces of the prior art.

The "visibly thick outflow" advantages of the present invention can be realized at flow rates at or above 1.0 GPM (where 1 GPM is widely considered to be a "water conserving" flow rate for faucets). The spray insert assembly of the present invention has an outflow generating face member which generates a plurality of (e.g., 12 to 24) laminar or concentrated jets to develop spray energy or force to clean soap, dirt, food, etc. from the target surface. The nozzle assembly of the present invention advantageously integrates one or more fluidic oscillators with interaction chambers and outlet orifices aimed from a central area of the spray face member's distal surface to generate one or more visibly "thick" distally projecting oscillating sprays which are combined with the conventional needle jet or planar sheet sprays to generate a composite multi-part spray with a satisfyingly "thick and apparently dense outflow having some portions with higher velocity to provide efficient use and spatial distribution of the restricted outflow.

The compound spray of the present invention thus includes one or more central oscillating sprays which are visibly "thick" in the center of the faucet's outflow and that thick oscillating spray is surrounded by the concentrated jets of higher velocity to generate a compound flow restricted spray having an apparent outflow thickness which is substantially equal to the fixtures unrestricted outflow. A typical kitchen faucet's outlet orifice has a lumen diameter of approximately % of an inch or about 1.5 cm, meaning an unrestricted kitchen faucet outflow is about as thick as an adult's thumb. The compound outflow generated by the nozzle or insert assembly of the present invention is thus comprised of a plurality of conventional and oscillating sprays which, in use, appear to be as thick (or have an apparent cross sectional diameter) that is also approximately ¾ of an inch or about 1.5 cm, meaning a kitchen faucet equipped with the nozzle or insert assembly of the present invention generates a visibly dense compound outflow which appears to be about as thick as an adult's thumb.

Based on the desired (qualitative) spray intensity desired, applicants have scaled and combined a selected number of fluidic cup oscillator geometries (e.g., singular or in an array of three fluidics), with other generic spray features like needle jets or laminar sheets. This combination has been found to generate particularly pleasing spray aesthetics with acceptable spray performance. In an embodiment incorporating an array of three fluidic oscillators (e.g., three fluidic cup geometries), the three oscillator outlet orifices are aimed to spray distally from the center of a circular face, where the perimeter of the face includes an encircling array or ring of small individual laminar sheet spray generating slot-shaped orifices.

In an alternative embodiment, three fluidic oscillators (e.g., three fluidic cup geometries) define three oscillator outlet orifices aimed to spray distally from the center of the circular face, and the perimeter of the face includes an encircling array or ring of small individual needle-jet spray generating circular orifices. In both embodiments, the sprays take advantage of the fluidic's efficient use of water flow rate while not appearing too different from traditional sprays on the exterior face. The nozzle assembly or insert housing also encloses a spray manifold to the flow regulator which creates the final sealing surfaces for the fluidic circuits and also conditions the incoming flow as not to create fluid dynamic biases of the spray.

In accordance with the present invention, each fluidic oscillator is configured or molded in-situ into the proximal or interior surface circular face member of the nozzle assembly's housing, and that circular face member's distal or exterior surface defines the plurality of laminar spray outlets or needle spray outlets and the (preferably) plurality of oscillating spray outlets which generate the composite multiple-velocity spray of the present invention.

Each fluidic oscillator geometry molded or configured within the proximal or interior surface circular face member defines a conformal, cup-shaped fluidic oscillator aimed to generate a distally projecting oscillating spray. Each fluidic oscillator is configured with an interaction chamber having laterally opposed inlets or power nozzle channels which are in fluid communication with a substantially open proximal end (facing the nozzle assembly's interior) and those opposing power nozzles generate opposing flows aimed toward one another to intersect and collide within the interaction chamber and to generate a distally projecting oscillating selected fluid spray from the interaction chamber. The nozzle assembly is optionally configured with a selected number of oscillating spray generating outlet orifices (e.g., one to three or more) that dictate an oscillating spray coverage pattern and distribution, where outlet geometries are chosen so that sprays from each oscillator's outlet are aimed to generate distinct oscillating spray streams, to provide substantially parallel droplet trajectories and to preserve the selected droplet size generated by each outlet's oscillating spray.

The nozzle assembly's spray face member's features or fluid channel defining geometries are preferably molded directly into the proximal surface of the spray face member which is then affixed to at least one housing sidewall defining cylindrical member having an open distal end which is sealed to a proximally projecting flange member defined at the perimeter of the spray face member, to define a fluid-tight enclosed volume having a substantially open proximal end and a housing interior. The faucet insert assembly's housing also contains a manifold main body and a manifold fluidic sealing surface which cooperate with the features molded into the proximal surface of the spray face member to define (a) fluidic inlet lumens or power nozzle inlet lumens that are in fluid communication with each fluidic oscillator's interaction region or chamber, and (b) needle jet spray generating orifice inlet lumens or laminar spray generating orifice inlet lumens.

The configuration of the proximal surface of spray face member (including the fluidic oscillator geometries and the conventional spray lumens) eliminates the need for an assembly made from a fluidic circuit-defining insert which is received within a separate housing cavity. The present invention provides a multi-inlet, multi-outlet spray face member which can be configured to project a plurality of desired spray patterns (e.g., 3-D or rectangular oscillating patterns of uniform droplets). The multi-outlet spray face of the present invention optionally includes a fluid dynamic mechanism for generating a fluid spray oscillation that is conceptually similar to that shown and described in commonly owned U.S. Pat. Nos. 7,267,290 and 7,478,764 (Gopalan et al) which describe a planar mushroom fluidic circuit's operation; both of these patents are hereby incorporated herein in their entireties by reference.

The fluidic geometries described above define the fluidic oscillator structures in the proximal surface of the spray face where the faucet's water flow is received in a proximal open end or inlet of the insert assembly and that fluid flows distally within the housing's interior around the manifold mail body and along the housing's cylindrical sidewall. The fluid then flows into the oscillator power nozzle lumens which can be tapered or include step discontinuities (e.g., with an abruptly smaller or stepped inside diameter) to enhance the pressurized fluid's instability as it flows into the interaction region.

Preferably, the power nozzles are venturi-shaped or tapered channels or grooves in the inner face of the distal wall of the spray face member's cup-shaped fluidic circuit and all terminate in a common, nearly rectangular or box-shaped interaction region defined in that inner face. The interaction region configuration affects the spray pattern(s).

The cup-shaped fluidic circuit power nozzles, interaction region and discharge outlet(s) can be defined in a disk or pancake-shaped insert fitted within the insert assembly, but are preferably molded directly into the spray face member's interior wall segments. When molded from plastic as a one-piece, multi-inlet, multi-outlet fluidic circuit defining member, the spray face member is easily and economically fitted into an insert assembly's housing along with the manifold main body and the manifold sealing surface, which typically has a distal or outer face that is substantially flat and fluid impermeable. The manifold sealing surface is then in flat face sealing engagement with the spray face member's inner face. The manifold sealing surface peripheral wall and the spray face member's peripheral wall are coaxial and are radially spaced to define an annular fluid channel therebetween. These peripheral walls are generally parallel with each other but the annular space may be tapered to aid in developing greater fluid velocity to create fluidic flow instability and thus oscillation.

As a multi-outlet fluidic circuit item for sale or shipment to others, the multi-spray generating insert or nozzle assembly of the present invention is configured for easy and economical incorporation into a faucet or spray head for spraying pressurized water or fluid to generate a very satisfying compound spray at moderate flow rates.

The above and still further objects, features and advantages of the present invention will become apparent upon consideration of the following detailed description of specific embodiments, particularly when taken in conjunction with the accompanying drawings, wherein like reference numerals in the various figures are utilized to designate like components.

DESCRIPTION OF THE PREFERRED EMBODIMENT

Figure 1:
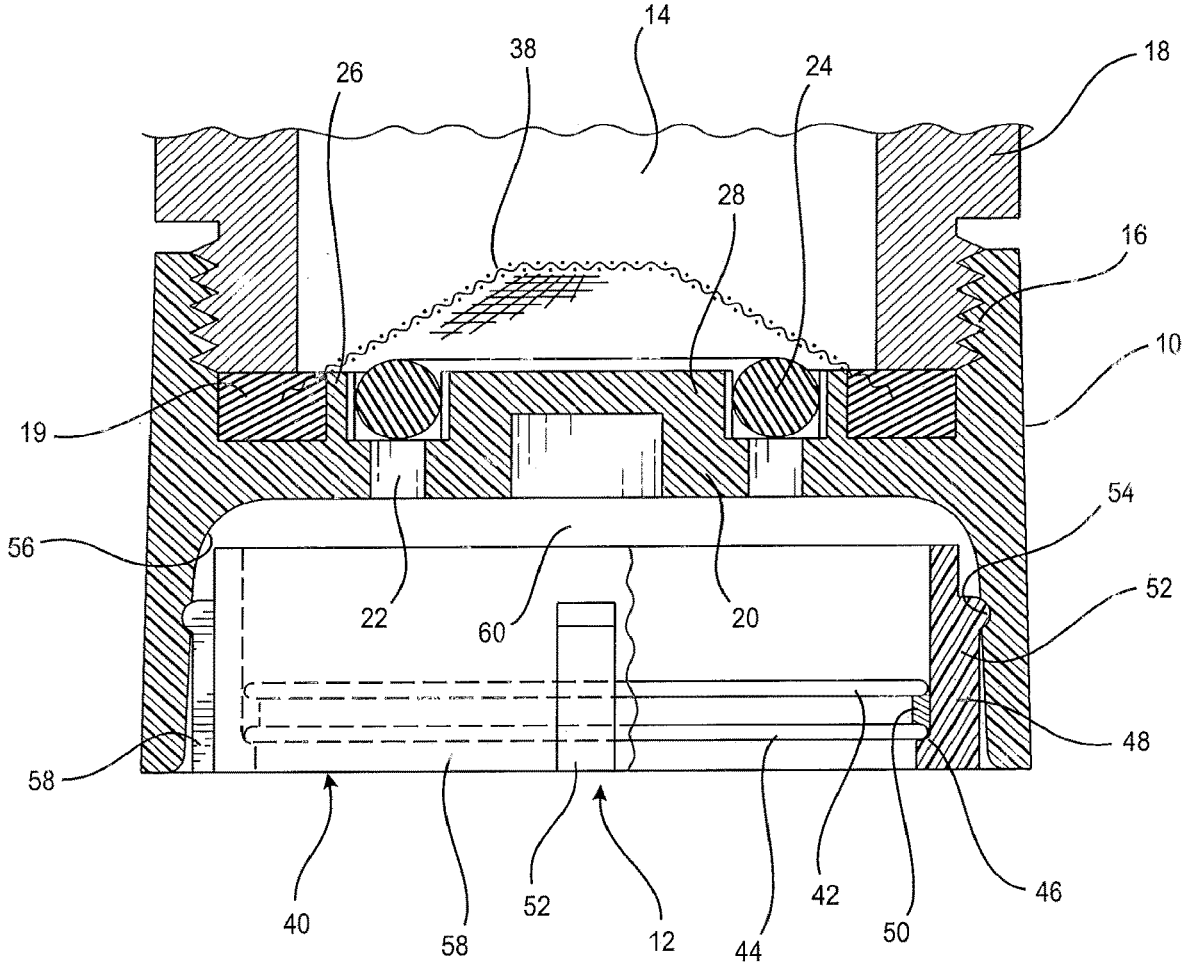
FIG. 1 is a cross sectional view in elevation of a typical flow controlling faucet insert, in accordance with the Prior Art.

FIG. 1 shows a typical flow controlling faucet insert assembly or aerator insert used in the prior art, and this figures' insert assembly was described above to provide added background and context. Referring again to FIG. 1, a typical (e.g., "flo-control") aerator housing is indicated at 10 and includes an outlet or discharge 12 and an inlet end 14 aligned along a central axis within the faucet's spout 18. A conventional faucet's flow is generally along the central axis of the insert's housing 10, from inlet 14 to outlet 12, so, for purposes of nomenclature, "downstream" is in the flow direction generally from inlet 14 to outlet 12 or moving from a proximal (e.g., inlet side) location to a distal (e.g., outlet side) location. The typical threads 16 shown at the upstream end of the housing 10 are universal, in such fixtures, so similar threads can be incorporated to attach the flow restricted insert assembly or nozzle assembly of the present invention to a typical faucet or sprayer's spout 18.

Referring now to FIGS. 2-9, a flow-restricted or water conserving nozzle assembly 100 (see FIGS. 7-9) is illustrated for use in a faucet or hand sprayer (not shown, but similar to universal faucet spout 18 in FIG. 1), and has one or more fluidic oscillating chambers configured within the nozzle assembly 100 to generate one or more oscillating sprays which, when combined with conventional (e.g., jet or planar sheet) sprays simultaneously regulate the volume of water passing through the nozzle assembly while providing a satisfying compound spray for washing and rinsing.

Figure 2:
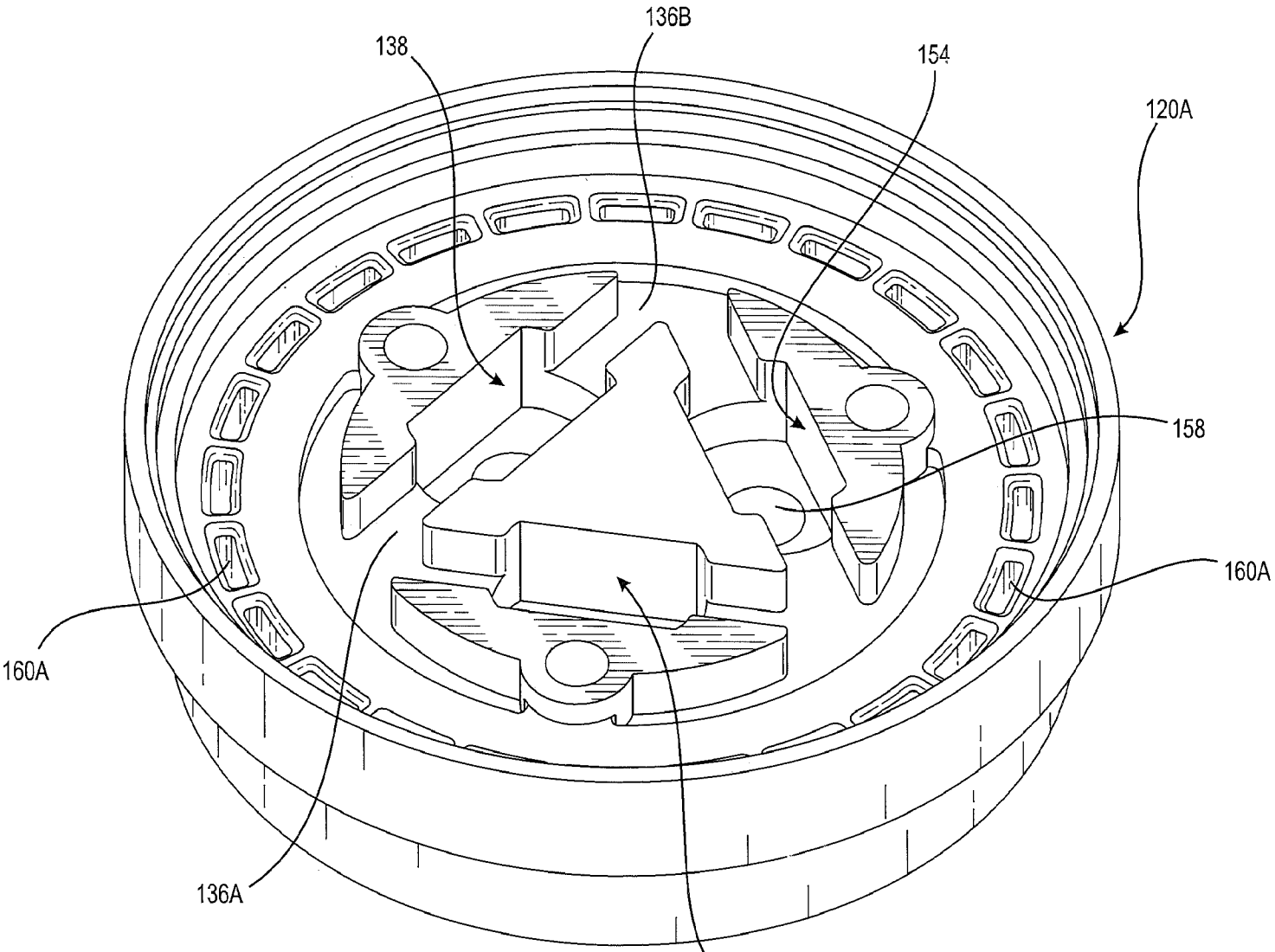
FIG. 2 is a perspective view illustrating the interior surfaces of a compound spray generating flow restricted fluidic faucet spray face member including, in the illustrated embodiment an array of three fluidic oscillator geometries, showing the oscillation-inducing geometries or features defined within an encircling peripheral array of twenty four (24) laminar jet producing slot shaped orifices in accordance with a first embodiment of the present invention.
Figure 3:
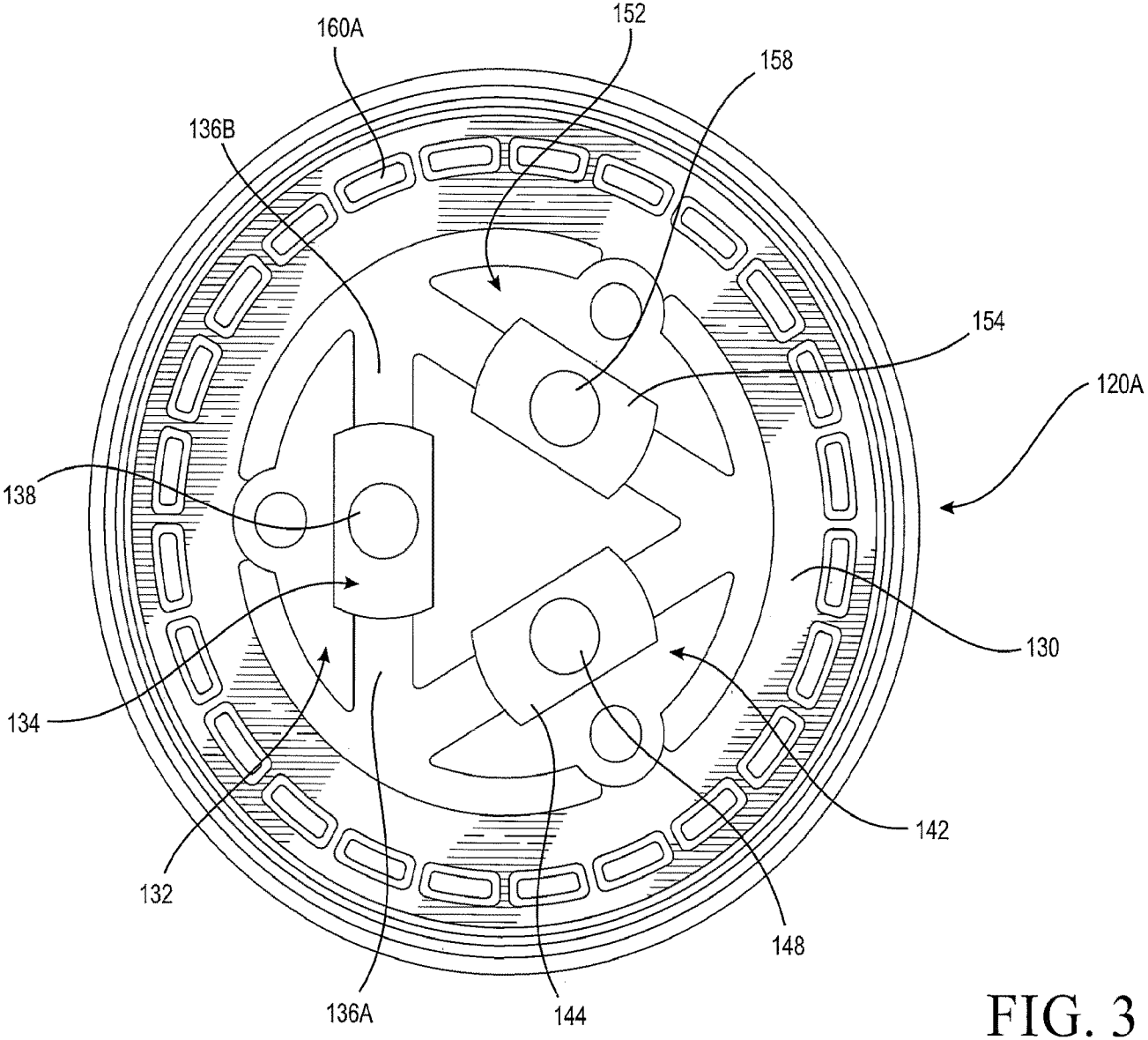
FIG. 3 is a plan view in elevation of the spray face member of FIG. 2 illustrating the interior surface features and lumens defined through the compound spray generating flow restricted fluidic faucet spray face member including, in the illustrated embodiment, an array of three fluidic oscillator geometries, showing the oscillation-inducing geometries and outlet orifices defined within the encircling peripheral array of twenty four (24) laminar jet producing slot shaped orifices in accordance with a first embodiment of the present invention.
Figure 9:
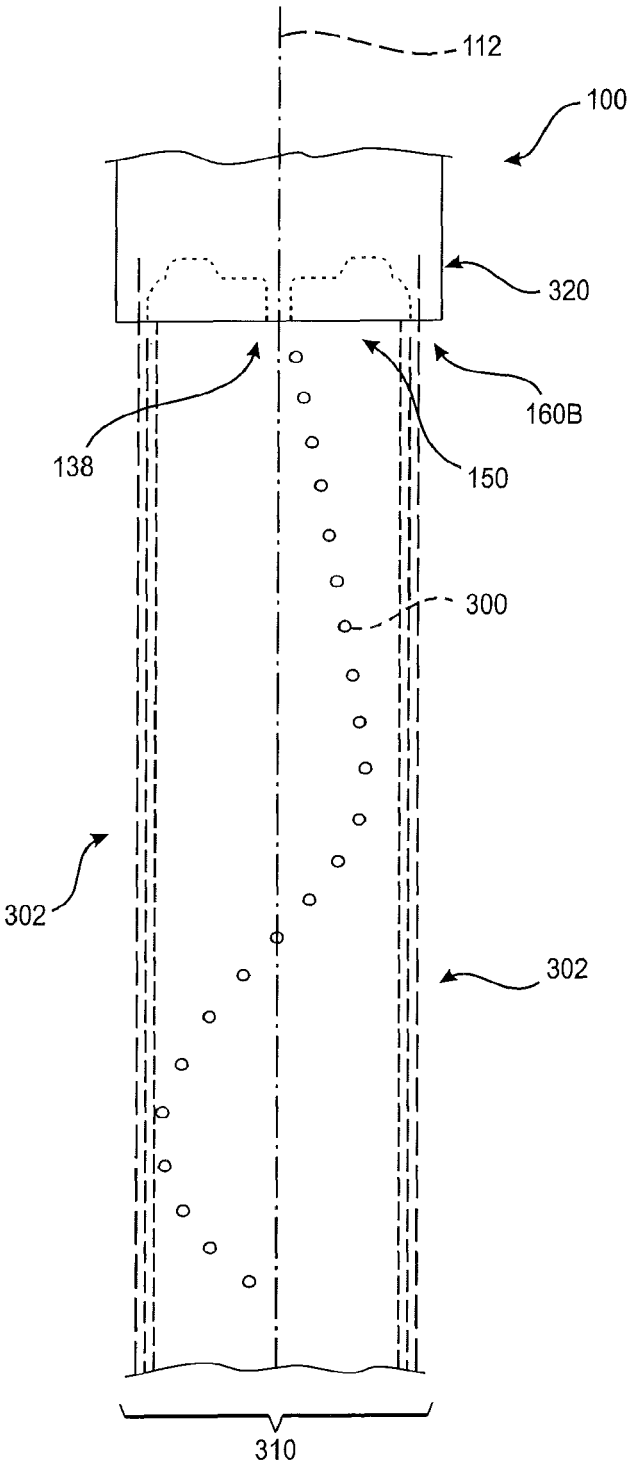
FIG. 9 is a side view in elevation of the nozzle or insert assembly of the present invention illustrating the visibly "thick" and dense compound spray generated by the fluidic faucet spray face member's fluidic oscillator(s) and encircling laminar jet or needle jet orifices, in accordance with the present invention.

In accordance with the present invention, a nozzle or faucet insert device or assembly 100 is configured in a substantially cylindrical housing 110 having an interior volume defined symmetrically around a central axis 112 which supports and provides a fluid supply channel for a spray face member (e.g., 120A, as shown in FIGS. 2 and 3 or 120B, as shown in FIGS. 4-7) which packages one, two or more fluidic cup oscillators with interaction chambers adapted to work within a traditional faucet aerator insert's package space (i.e., within the same external volume as prior art aerator housing 10) for typical kitchen and lavatory faucet flow regulators. In the embodiment of the nozzle assembly described here and illustrated in FIGS. 2-9, a new structure and method enable a visibly "thick" compound spray (as best seen in FIG. 9) which provides a more satisfying outflow and improved cleaning and rinsing at low flow rates. For example, at typical plumbing supply pressures of 10-80 psi and when used in conjunction with a flow regulating device (e.g., a NeoPerl® brand flow regulator) the fluidic geometry in the spray face of insert assembly 100 will provide superior rinsing and cleaning at lower flow rates (e.g., between 0.15 GPM and 0.70 GPM) compared to more generic aerated, laminar or needle jet spray faces of the prior art. For purposes of nomenclature, a flow regulator is a component which maintains a predefined flow rate near-constantly and mostly independently from the prevailing line pressure. The exemplary embodiment represents one of applicant's prototypes which has been tested and evaluated with an commercially available NEOPERL® flow regulator, mounted inline, where it compensated for pressure variations between 1 and 8 bar. Insert assembly 100 and particularly housing 110 may be formed in machinable or moldable sections of a suitable metal, such as brass, or may be made of a suitable plastic.

The visible "thick, dense spray" advantages of the present invention can be realized at flow rates at or above 1.0 GPM. Spray insert assembly 100 has an outflow generating face member (e.g. 120A or 120B) which generates a plurality (e.g., preferably 12 to 24) laminar or concentrated jets to develop spray energy or force to clean soap, dirt, food, etc. from the target surface. Nozzle or insert assembly 100 advantageously integrates one or more fluidic oscillators with interaction chambers and outlet orifices aimed from a central area of the spray face member's distal surface 150 along central spray axis 112 to generate one or more visibly "thick" distally projecting oscillating sprays 300 which are combined with the conventional needle jet or planar sheet sprays 302 to generate a composite multi-part or compound spray 310 with a satisfyingly "thick" and apparently dense outflow having some portions with higher velocity to provide efficient use and spatial distribution of the restricted outflow.

The compound spray 310 of the present invention thus includes one or more central oscillating sprays 300 which sweep laterally very quickly, but, when seen by the user appear to be visibly "thick" in the center of the faucet's outflow and that thick oscillating spray 300 is surrounded by the concentrated jets 302 of higher velocity to generate a compound flow restricted spray 310 having an apparent outflow thickness which is substantially equal to the fixture's expected outflow, if unrestricted. A typical kitchen faucet's outlet orifice (e.g., for faucet spout 16) has a spout or lumen diameter 320 of approximately ¼ of an inch or about 1.5 cm, meaning an unrestricted kitchen faucet outflow transverse thickness is about as thick as an adult's thumb. The compound outflow 310 generated by nozzle or insert assembly 100 is thus comprised of a plurality of conventional and oscillating sprays (e.g., 302 and 300) which, in use, appear to be as thick (or have an apparent cross sectional diameter) that is also approximately ¾ of an inch or about 1.5 cm, meaning a kitchen faucet equipped with the nozzle or insert assembly of the present invention generates a visibly dense compound outflow 310 which appears to be about as thick as an adult's thumb.

Based on the qualitatively desirable spray intensity required for compound flow restricted outflow 310, applicants have scaled and combined a selected number of (preferably fluidic cup) oscillator geometries (e.g., 132, 142, and 152, singular or in an array of three fluidics clustered about central axis 112 in the central portion of interior surface 130), with non-oscillating spray generating features like needle jet generating lumens 160B or laminar sheet generating slots 160A. This combination has been found to generate particularly pleasing spray aesthetics with acceptable spray performance. In an embodiment incorporating an array of three fluidic oscillators (e.g., three fluidic cup geometries 132, 142, 152), the three oscillator outlet orifices (e.g., 138, 148 and 158) are aimed along axis 112 to spray distally from the center of the distal circular surface 150 of the face member (e.g., 120A or 120B), where the perimeter of the distal circular surface 150 includes an encircling array or ring of small individual non-oscillating spray generating orifices (e.g., slots 160A as best seen in FIGS. 2 and 3).

Figure 4:
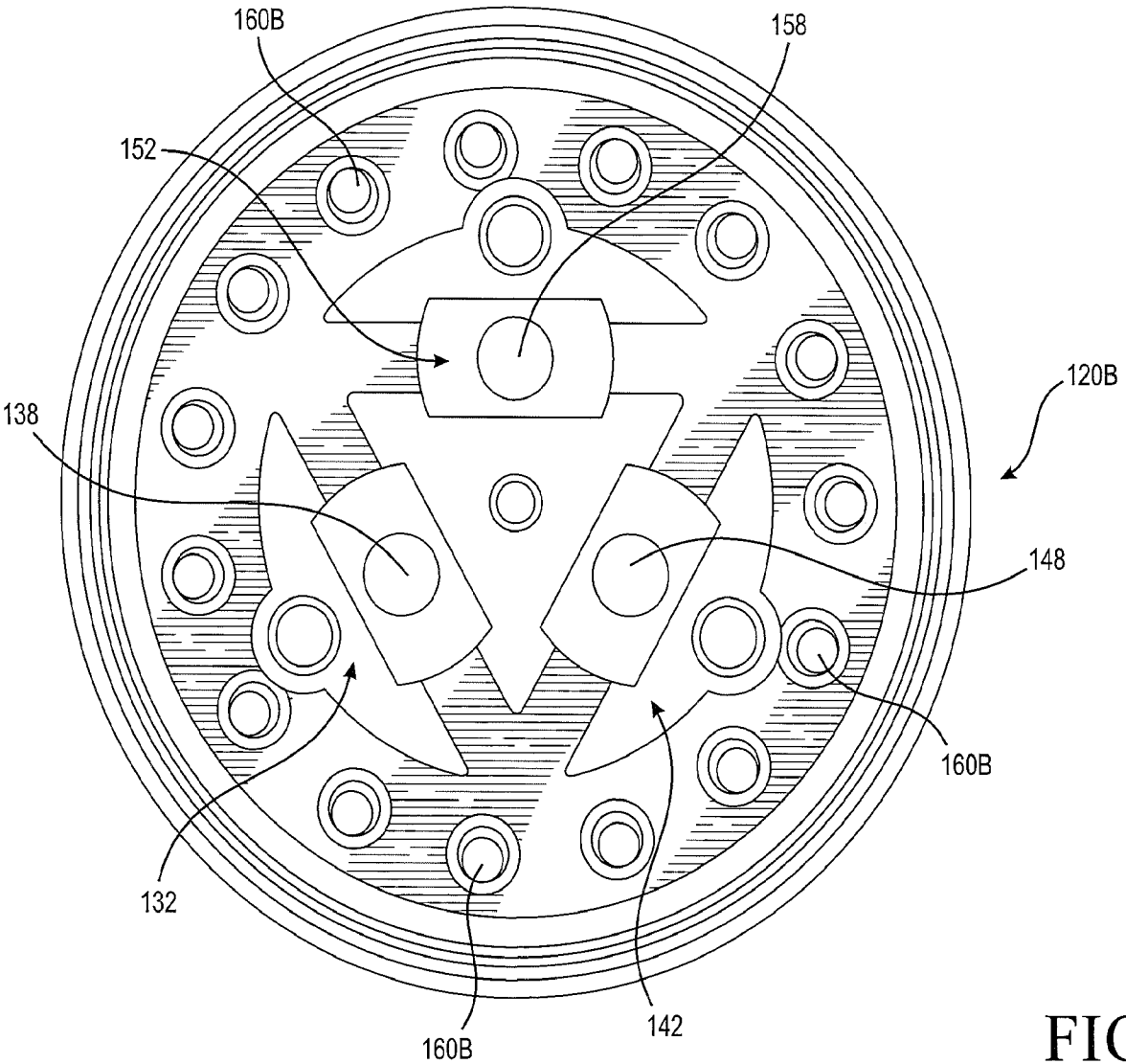
FIG. 4 is a plan view in elevation of another spray face member illustrating the interior surface features and lumens defined through a second compound spray generating flow restricted fluidic faucet spray face member including, in the illustrated embodiment, an array of three fluidic oscillator geometries, showing the oscillation-inducing geometries and outlet orifices defined within an encircling peripheral array of fifteen (15) needle jet producing tapered lumens with circular orifices in accordance with a second embodiment of the present invention.
Figure 5:
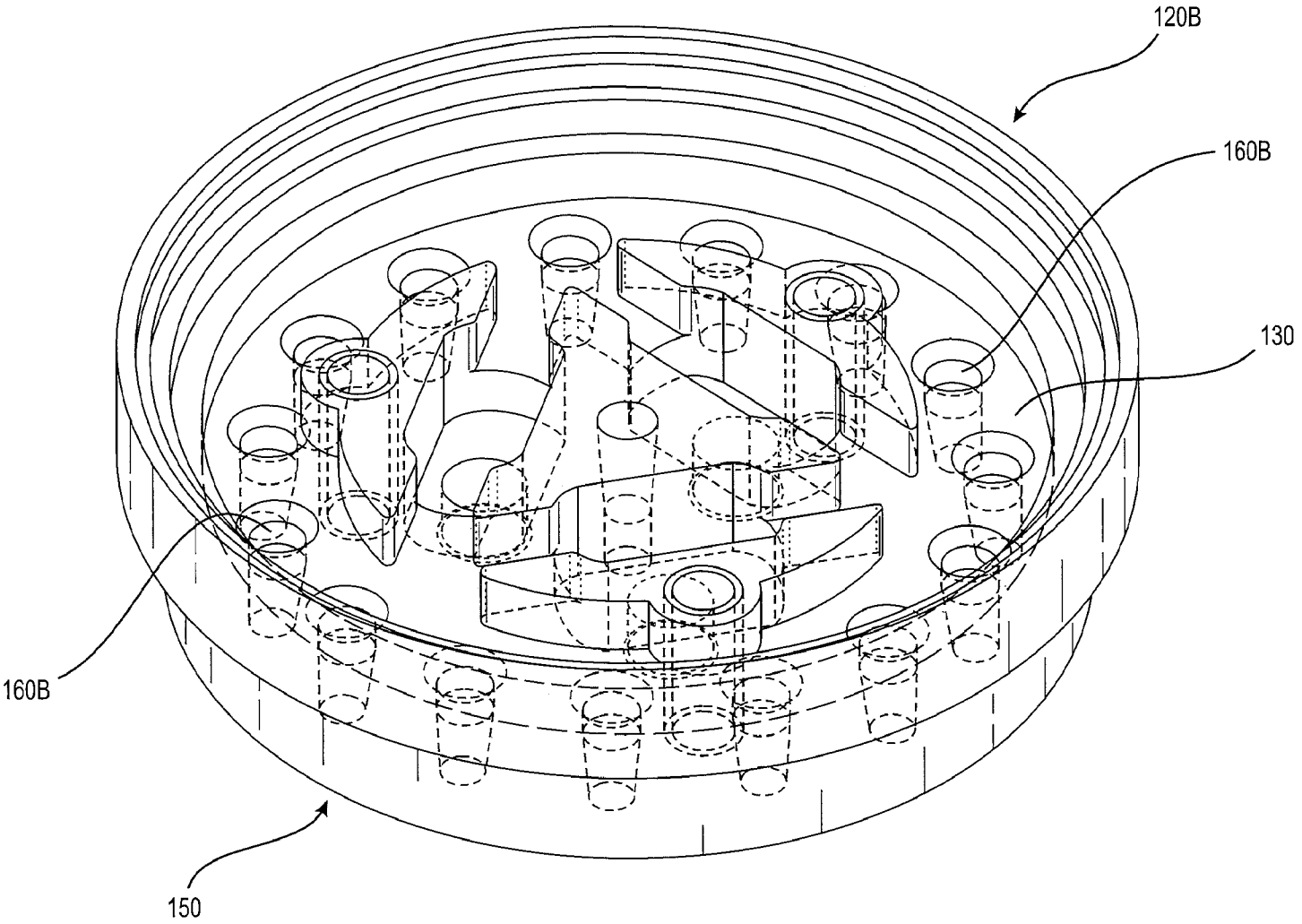
FIG. 5 is a diagram illustrating, in a perspective view, relationships among the interior surfaces of the compound spray generating flow restricted fluidic faucet spray face member of FIG. 4 including, in the illustrated embodiment the array of three fluidic oscillator geometries, showing the oscillation-inducing geometries or features defined within the encircling peripheral array of fifteen (15) needle jet producing tapered lumens which are aimed to produce the desired compound spray, in accordance with the second embodiment of the present invention.
Figure 6:
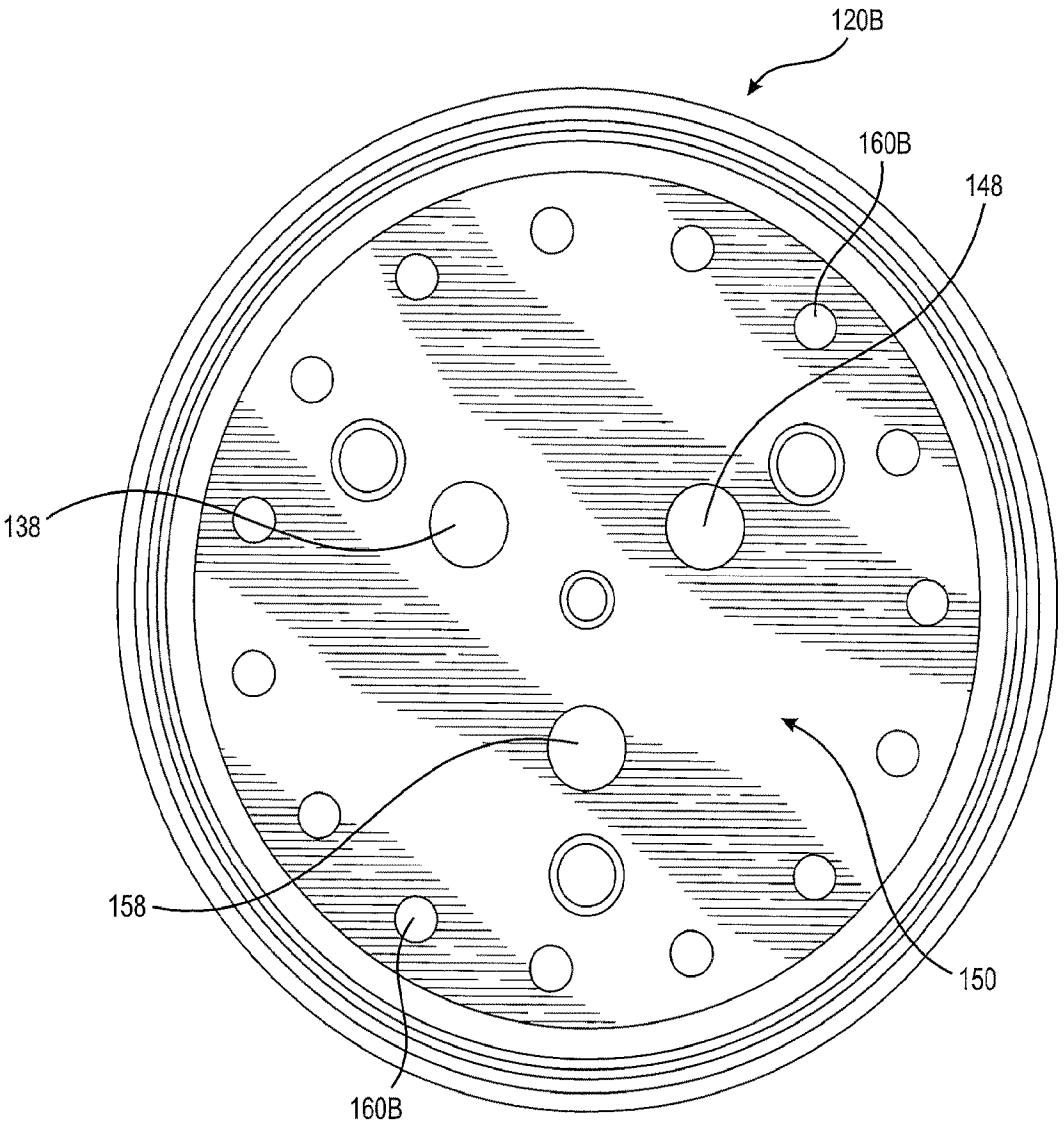
FIG. 6 is a bottom or distal end view, in elevation, of the compound spray generating flow restricted fluidic faucet spray face member of FIGS. 3, 4 and 5 including, in the illustrated embodiment the array of three central fluidic oscillator outlet orifices, showing the oscillating-spray generating fluidic outlet orifices aimed distally from within the encircling peripheral array of fifteen (15) needle jet producing tapered lumens which are each aimed or slanted slightly away from the central axis to produce the desired compound spray, in accordance with the second embodiment of the present invention.

In the jet-spray embodiment of FIGS. 4-6, three fluidic oscillators (e.g., three fluidic cup geometries 132, 142, 152) define three oscillator outlet orifices (e.g., 138, 148, 158) aimed to spray distally from the center of the distal circular surface 150, and the perimeter of the face includes an encircling array or ring of small individual needle-jet spray generating circular orifices 160B. In both embodiments, the compound sprays generated (e.g., 310) take advantage of the fluidics' efficient use of water flow rate while not appearing too different from traditional sprays on the exterior face. The nozzle assembly or insert housing also encloses a spray manifold member 202 to the flow regulator which creates the final sealing surfaces for the fluidic circuits and also conditions the incoming flow as not to create fluid dynamic biases of the spray.

In accordance with the present invention, each fluidic oscillator (e.g., three fluidic cup geometries 132, 142, 152) is configured or molded in-situ into the proximal or interior surface 130 of circular face member 120 which is supported in the nozzle assembly's housing 110, and that circular face member's distal or exterior surface 150 defines the plurality of laminar spray outlets 160A or needle spray outlets 160B and the (preferably) plurality of oscillating spray outlets (e.g., 138, 148, 158) which generate the composite multiple-velocity spray 310 of the present invention.

Each fluidic oscillator geometry (e.g., 132, 142, 152) molded or configured within the proximal or interior surface 130 of a circular face member defines a conformal, cup-shaped fluidic oscillator aimed to generate a distally projecting oscillating spray substantially along or parallel to central axis 112. Each fluidic oscillator is configured with an interaction chamber (e.g., 134, 144, 154) having laterally opposed inlets or power nozzle channels (e.g., 136A, 136B) which are in fluid communication with a substantially open proximal end (facing the nozzle assembly's interior) and those opposing power nozzles generate opposing flows aimed toward one another to intersect and collide within the interaction chamber (e.g., 134) and to generate a distally projecting oscillating fluid spray from the interaction chamber through the fluidic's outlet orifice (e.g., 138). The nozzle assembly is optionally configured with a selected number of oscillating spray generating outlet orifices (e.g., one to three or more) that dictate an oscillating spray coverage pattern and distribution e.g., to generate compound spray 310), where outlet geometries are chosen so that sprays from each oscillator's outlet are aimed to generate distinct oscillating spray streams, to provide substantially parallel droplet trajectories and to preserve the selected droplet size generated by each outlet's oscillating spray.

The nozzle assembly's spray face member's features or fluid channel defining geometries (e.g., three fluidic cup geometries 132, 142, 152) are preferably molded directly into the proximal surface of the spray face member which is then affixed to at least one housing sidewall defining cylindrical member 110 having an open distal end which is sealed to a proximally projecting flange member defined at the perimeter of the spray face member (e.g., 120A or 120B), to define a fluid-tight enclosed volume having a substantially open proximal end and a housing interior to receive pressurized water or fluid from a fixture or faucet spout (e.g., 16). The faucet insert assembly's housing 110 also contains a manifold main body 202 and a manifold fluidic sealing surface defining member 210 which cooperate with the features molded into the proximal surface 130 of the spray face member (e.g., 120A or 120B) to define (a) fluidic inlet lumens or power nozzle inlet lumens (e.g., 136A, 136B) that are in fluid communication with each fluidic oscillator's interaction region or chamber (e.g., 134, 144, 154), and (b) needle jet spray generating orifice inlet lumens 120B or laminar spray generating orifice inlet lumens 120A.

The configuration of the proximal or interior surface 130 of spray face member (including the fluidic oscillator geometries and the conventional spray lumens) eliminates the need for an assembly made from a fluidic circuit-defining insert which is received within a separate housing cavity. The present invention provides a multi-inlet, multi-outlet spray face member which can be configured to project a plurality of desired spray patterns (e.g., 3-D or rectangular oscillating patterns of uniform droplets). The multi-outlet spray face (e.g., 120A or 120B) of the present invention optionally includes a fluid dynamic mechanism for generating a fluid spray oscillation that is conceptually similar to that shown and described in commonly owned U.S. Pat. Nos. 7,267,290 and 7,478,764 (Gopalan et al) which describe a planar mushroom fluidic circuit's operation; both of these patents are hereby incorporated herein in their entireties by reference.

The fluidic geometries described above define the fluidic oscillator structures in the proximal surface of the spray face where the faucet's water flow is received in a proximal open end or inlet of the insert assembly and that fluid flows distally within the housing's interior around the manifold main body 202 and along the housing's cylindrical sidewall. The fluid then flows into the oscillator power nozzle lumens (e.g., 136A, 136B) which can be tapered or include step discontinuities (e.g., with an abruptly smaller or stepped inside diameter) to enhance the pressurized fluid's instability as it flows into the interaction region (e.g., 134).

Optionally, the power nozzles (e.g., 136A, 136B) are venturi-shaped or tapered channels or grooves in the inner face 130 of the distal wall of the spray face member's cup-shaped fluidic circuit and all terminate in a common, nearly rectangular or box-shaped interaction region (e.g., 134) defined in that inner face. The interaction region configuration affects the transverse thickness and oscillation frequency of the oscillating spray pattern(s) (e.g., 300).

Figure 7:
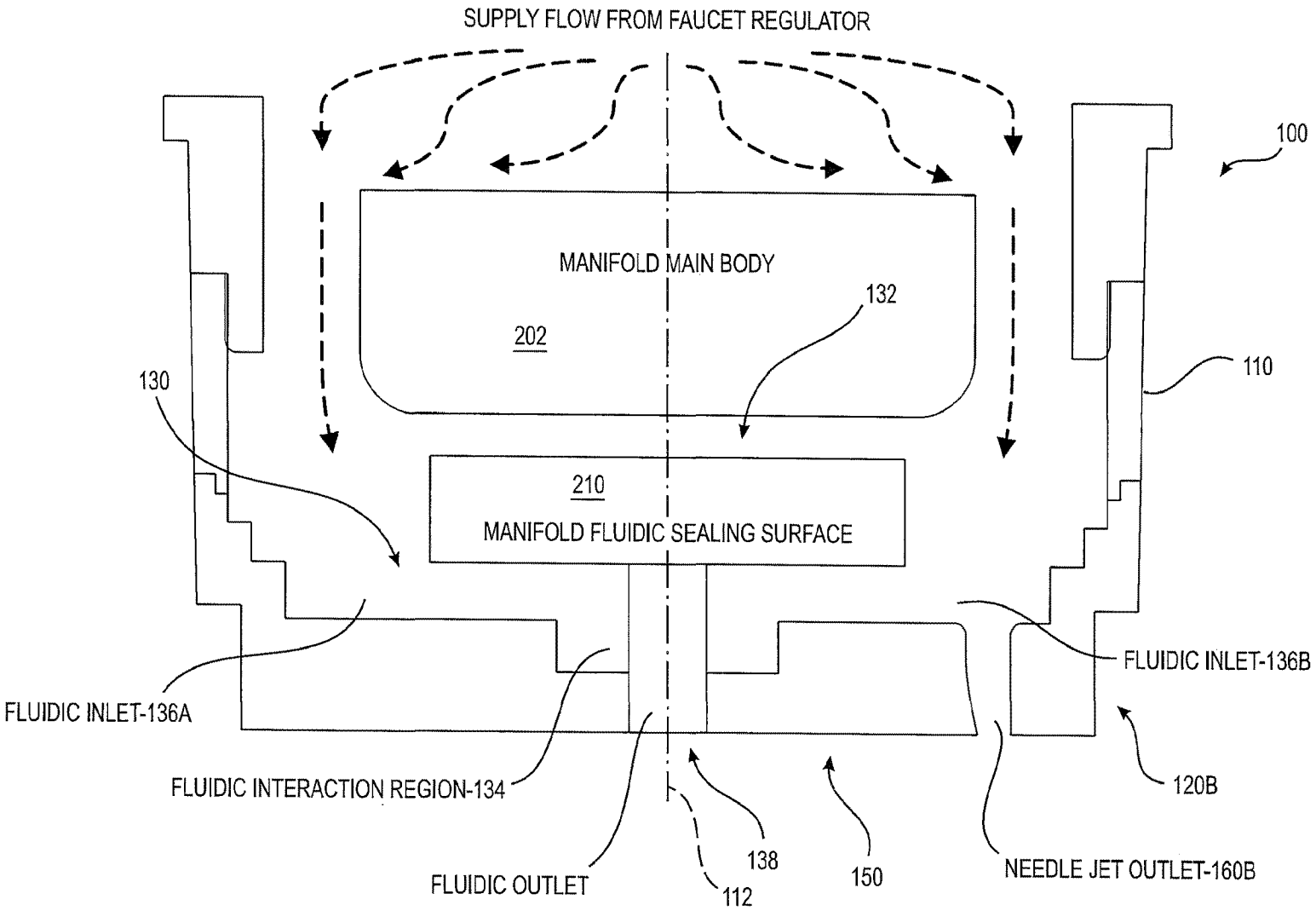
FIG. 7 is a diagram oriented to illustrate a side view in elevation of a nozzle or insert assembly including the spray face member of FIGS. 3-6 illustrating the housing's interior features and the annular fluid channel or lumen which supplies water or fluid to the compound spray generating flow restricted fluidic faucet spray face member including, in the illustrated embodiment, a manifold main body and a manifold fluidic sealing surface which engage and seal against the spray face member's interior feature-defining surfaces to define the power nozzle lumens and the interaction chambers or regions of the fluidic oscillator geometries, showing fluid flow path from the upstream open inlet to the oscillation-inducing geometries and outlet orifices defined within the encircling peripheral array of jet producing orifices, in accordance with the second embodiment of the present invention.
Figure 8:
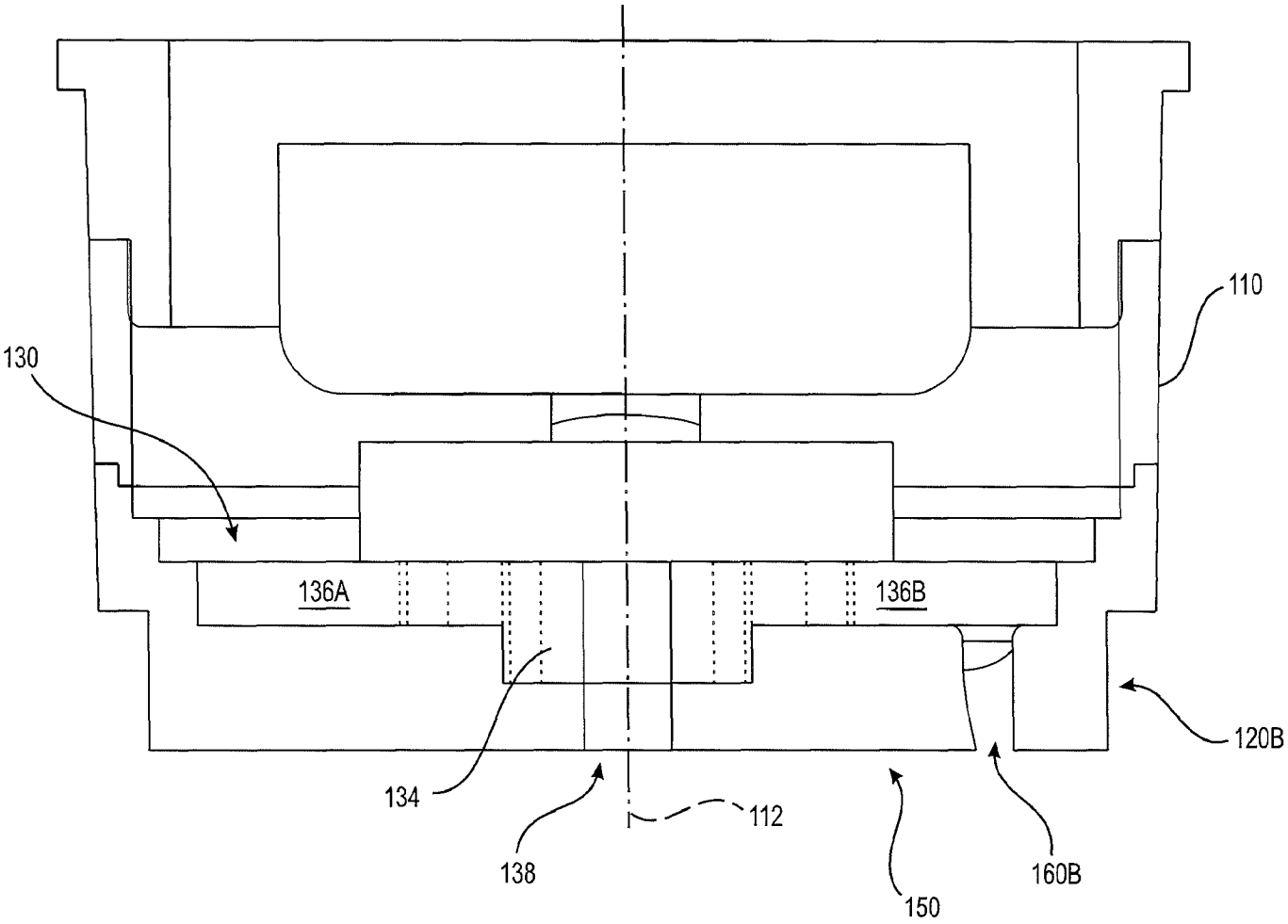
FIG. 8 is a side view in elevation of the nozzle or insert assembly of FIG. 7 illustrating the housing's interior features and the fluidic faucet spray face member's internal features, in accordance with the second embodiment of the present invention.

The cup-shaped fluidic circuit power nozzles (e.g., 136A, 136B) interaction region and discharge outlet(s) (e.g., 138, 148, 158) can be defined in a disk or pancake-shaped insert (not shown) fitted within the insert assembly 100, but are preferably molded directly into the spray face member's interior wall surface 130. When molded from plastic as a one-piece, multi-inlet, multi-outlet fluidic circuit defining member, the spray face member (e.g., 120A, 120B) is easily and economically fitted into an insert assembly's housing 110 along with the manifold main body 202 and the manifold sealing surface defining member 210, which typically has a distal or outer face that is substantially flat and fluid impermeable. The manifold sealing surface defining member's distal surface is then in flat face sealing engagement with the spray face member's inner face 130. The manifold sealing surface defining member's peripheral wall and the spray face member's peripheral wall are coaxial and are spaced to define an annular fluid channel therebetween (as best seen in FIG. 7). These peripheral walls are generally parallel with each other but the annular space may be tapered to aid in developing greater fluid velocity to create fluidic flow instability and thus oscillation.

As a multi-outlet fluidic circuit item for sale or shipment to others, the multi-spray generating insert or nozzle assembly 100 is configured for easy and economical incorporation into a faucet or spray head (e.g., 16) for spraying pressurized water or fluid to generate a very satisfying compound spray 310 at moderate flow rates.

It will be appreciated by persons of skill in the art that flow-restricted compound spray generating device 100 is readily configured for attachment to and use with a faucet or fixture (e.g., 16) having a spout with a spout orifice diameter, and essentially comprises a housing 110 having a water inlet and outlet aligned along a central or spray axis 112, where the housing 110 defines an interior cavity or volume terminating distally at the housing's distal or outlet end in a spray face member (e.g., 120A, 120B) having an interior surface 130 in fluid communication with the housing's inlet and the faucet's water supply. The spray face member's interior and an exterior surfaces have a central area surrounded by a periphery defining the spray face member's peripheral edge. The spray face member also includes at least a first fluidic circuit oscillator defining geometry including an outlet orifice (e.g., 138) in the central area configured to aim an oscillating spray (e.g., 300) having a selected oscillating spray thickness distally along the spray axis 112. As described above, the spray face member also including a plurality (e.g., 12 to 24) non-oscillating (e.g., laminar or jet) spray generating orifices (e.g., 160A, 160B) arrayed evenly around the spray face member's periphery to aim a plurality of non-oscillating laminar or jet sprays distally along spray axes which are either parallel to or slightly diverging from the central spray axis 112.

When in use, the plurality of non-oscillating laminar or jet sprays (e.g., from 160A or 160B) project distally along an axis which is either parallel to or slightly diverging from the central spray axis 112 to define a plurality of high velocity streams (e.g., 302) arrayed along spray axes which define a ring of spray with a diameter which is substantially equal to or larger than the spout orifice diameter 320. The transverse width or thickness of the oscillating spray(s) 300 is substantially equal to the spout orifice diameter 320 when viewed from a user's perspective (e.g., a side view resembling FIG. 9), so that compound outflow 310 is generated with a pleasing spray density with an apparent outflow thickness or transverse width (across axis 112) which is substantially equal to the spout orifice's diameter 320, thereby providing what appears to be a dense and full-width flow.

Flow-restricted compound spray generating device 100 can generate the ring of non-oscillating sprays 302 from a plurality (e.g., 15-24) non-oscillating laminar or jet spray generating orifices which comprise an annular array of tapered lumens (e.g., 160B) or water passages extending distally through said spray face member (e.g., 120B) and those non-oscillating jet spray generating tapered lumens or water passages may be aimed to diverge slightly from the housing's central axis 112 or may be aimed in axes which are substantially parallel to central axis 112.

The flow-restricted compound spray generating device 100 may have one or more fluidic oscillators (e.g., 132, 142, 152) and if there are more than one, those oscillators oscillate independently from one another. This asynchrony between plural fluidic oscillators creates rapid and randomly sweeping oscillating flows from each fluidic outlet orifice (e.g., 138, 148, 158) where each of the fluidic oscillators' oscillating sprays have the required thickness to generate a spray having a thickness that is substantially equal to the spout orifice diameter and is within the annular pattern of jet sprays when viewed from a user's perspective.

In accordance with the method for generating a water-conserving compound spray of the present invention a nozzle or insert assembly 100 having a housing 110 is provided having a water inlet and outlet aligned along a central or spray axis 112 where the housing defines an interior fluid-tight channel terminating distally at the distal or outlet end in a spray face member (e.g., 120A, 120B) having an interior surface 130 in fluid communication the housing's inlet and interior and an exterior surface 150 having a central area surrounded by a periphery defining a spray face member peripheral edge. Next, spray face member is configured to include at least a first fluidic circuit oscillator geometry (e.g., three fluidic cup geometries 132, 142, 152) including an outlet orifice (e.g., 138, 148, 158) in the spray face member's central area and each fluidic's outlet orifices is configured to aim an oscillating spray (e.g., 300) having a selected oscillating spray thickness distally along the spray axis 112. The spray insert device is also provided, in the spray face member, a plurality of non-oscillating (e.g., laminar or jet) spray generating orifices (e.g., 160A or 160B) arrayed evenly around said spray face member's periphery to aim a plurality of non-oscillating laminar or jet sprays (e.g. 302) distally along an axis which is either parallel to or slightly diverging from the spray axis 112, and then the insert assembly is activated or made to generate the flow restricted compound spray 310 by forcing or introducing pressurized water through the spray face member 120A, 120B) to generate the desired plurality of non-oscillating (e.g., laminar or jet sprays, 302) distally along an axis which is either parallel to or slightly diverging from the spray axis to generate a plurality of high velocity non-oscillating streams which project along spray axes defining a ring of sprays with a diameter which is substantially equal to the spout orifice diameter 320 and generating at least one central oscillating spray 300 having an oscillating spray transverse thickness (across the spray axis), where the oscillating spray's transverse thickness is substantially equal to the spout orifice diameter when viewed from a user's perspective, so that a compound flow is generated having an apparent outflow which has a pleasing spray density with an apparent outflow thickness which is substantially equal to the spout orifice's diameter.

Having described preferred embodiments of a new and improved flow-restricted, water conserving nozzle or insert assembly and method, it is believed that other modifications, variations and changes will be suggested to those skilled in the art in view of the teachings set forth herein. It is therefore to be understood that all such variations, modifications and changes are believed to fall within the scope of the claims which also comprise part of the description of the present invention.

What is claimed is:

1. A flow-restricted compound spray generating device for a faucet or fixture having a spout with a spout orifice diameter, comprising:

(a) a housing having a water inlet and outlet aligned along a spray axis, said housing defining an interior terminating distally at said outlet in a spray face member having an interior surface in fluid communication with said inlet and interior of said housing and an exterior surface having a central area surrounded by a periphery defining a spray face member peripheral edge;

(b) said spray face member including at least a first fluidic circuit oscillator defining geometry including an outlet orifice that is configured or molded in-situ into the interior surface of said central area of said spray face member, said geometry includes an interaction chamber having laterally opposed power nozzle channels which are in fluid communication with an open proximal end and is configured to aim an oscillating spray having a selected oscillating spray thickness distally along the spray axis; and (c) said spray face member also including a plurality of non-oscillating laminar or jet spray generating orifices arrayed around a periphery of said spray face member to aim a plurality of non-oscillating laminar or jet sprays distally along an axis which is either parallel to or diverging from the spray axis;

(d) wherein the plurality of non-oscillating laminar or jet sprays distally along an axis which is either parallel to or diverging from the spray axis define a plurality of high velocity streams arrayed along spray axes which define a ring of spray with a diameter which is substantially equal to the spout orifice diameter;

(e) wherein the oscillating spray's oscillating spray thickness is substantially equal to the spout orifice diameter, so that a compound flow is generated having an apparent outflow with a spray density with an apparent outflow thickness which is substantially equal to or larger than the spout orifice's diameter.

2. The flow-restricted compound spray generating device of claim 1, wherein said spray face member's plurality of non-oscillating laminar or jet spray generating orifices comprise annularly arranged tapered lumens or water passages extending distally through said spray face member.

3. The flow-restricted compound spray generating device of claim 2, wherein said plurality of non-oscillating jet spray generating tapered lumens or water passages extending distally through said spray face member are aimed to diverge from the spray axis.

4. The flow-restricted compound spray generating device of claim 2, wherein said spray face member's plurality of non-oscillating jet spray generating tapered lumens or water passages extending distally through said spray face member comprise 12 to 24 jet sprays configured in a circular or annular pattern having a diameter which is substantially equal to the spout orifice diameter.

5. The flow-restricted compound spray generating device of claim 4, wherein said spray face member includes a second fluidic circuit oscillator defining geometry including a second fluidic outlet orifice that is configured or molding in-situ into the interior surface of said central area of said spray face member and is configured to aim a second oscillating spray having a selected oscillating spray thickness distally along the spray axis;

wherein said second fluidic oscillator's oscillating spray is not synchronized with said first oscillator's spray; and wherein said second fluidic oscillator's oscillating spray thickness is also substantially equal to the spout orifice diameter and is within the annular pattern of jet sprays.

6. The flow-restricted compound spray generating device of claim 5, wherein said spray face member includes a third fluidic circuit oscillator defining geometry including a third fluidic outlet orifice that is configured or molded in-situ into the interior surface of said central area of said spray face member and is configured to aim a third oscillating spray having a selected oscillating spray thickness distally along the spray axis;

wherein said third fluidic oscillator's oscillating spray is not synchronized with said first oscillator's spray or said second oscillator's spray; and wherein said third fluidic oscillator's oscillating spray thickness is also substantially equal to the spout orifice diameter and is within the annular pattern of jet sprays.

7. The flow-restricted compound spray generating device of claim 1, wherein said plurality of non-oscillating laminar spray generating orifices of said spray face member comprise annularly arranged slot-shaped lumens or water passages extending distally through said spray face member.

8. The flow-restricted compound spray generating device of claim 7, wherein said plurality of non-oscillating laminar spray generating tapered lumens or water passages extending distally through said spray face member are aimed to spray laminar jets along spray axes which are substantially parallel to the spray axis.

9. The flow-restricted compound spray generating device of claim 7, wherein said plurality of non-oscillating laminar spray generating tapered lumens or water passages extending distally through said spray face member comprise 12 to 24 laminar sprays configured in a circular or annular pattern having a diameter which is substantially equal to the spout orifice diameter.

10. The flow-restricted compound spray generating device of claim 9, wherein said spray face member includes a second fluidic circuit oscillator defining geometry including a second fluidic outlet orifice in said central area of said spray face member and is configured to aim a second oscillating spray having a selected oscillating spray thickness distally along the spray axis;

wherein said second fluidic oscillator's oscillating spray is not synchronized with said first oscillator's spray; and wherein said second fluidic oscillator's oscillating spray thickness is also substantially equal to the spout orifice diameter and is within the annular pattern of laminar sprays.

11. The flow-restricted compound spray generating device of claim 10, wherein said spray face member includes a third fluidic circuit oscillator defining geometry including a third fluidic outlet orifice in said central area of said spray face member and is configured to aim a third oscillating spray having a selected oscillating spray thickness distally along the spray axis;

wherein said third fluidic oscillator's oscillating spray is not synchronized with said first oscillator's spray or said second oscillator's spray; and wherein said third fluidic oscillator's oscillating spray thickness is also substantially equal to the spout orifice diameter and is within the annular pattern of laminar sprays when viewed from a user's perspective.

12. The flow-restricted compound spray generating device of claim 1, wherein said compound spray is generated when the faucet or fixture's water supply pressure is in a range of 10-80 PSI.

13. The flow-restricted compound spray generating device of claim 12, further comprising a flow regulating device.

14. The flow-restricted compound spray generating device of claim 12, wherein said device operates at flow rates between 0.15 GPM and 0.70 GPM.

15. The flow-restricted compound spray generating device of claim 12, wherein said device is configured to generate a compound spray pattern at flow rates above 1.0 GPM.

16. A method for generating a water-conserving compound spray, comprising:

(a) providing a nozzle or insert assembly housing having a water inlet and outlet aligned along a central or spray axis, said housing defining an interior terminating distally at said outlet in a spray face member having an interior surface in fluid communication with said housing's inlet and interior and an exterior surface having a central area surrounded by a periphery defining a spray face member peripheral edge;

(b) defining, in said spray face member at least a first fluidic circuit oscillator geometry including an outlet orifice that is configured or molded in-situ into the interior surface of said spray face member's central area said geometry includes an interaction chamber having laterally opposed power nozzle channels which are in fluid communication with an open proximal end and is configured to aim an oscillating spray having a selected oscillating spray thickness distally along the spray axis;

(c) defining, in said spray face member, a plurality of non-oscillating laminar or jet spray generating orifices arrayed around said spray face member's periphery to aim a plurality of non-oscillating laminar or jet sprays distally along an axis which is either parallel to or diverging from the spray axis;

(d) forcing water through said spray face member to generate a plurality of non-oscillating laminar or jet sprays distally along an axis which is either parallel to or diverging from the spray axis to generate a plurality of high velocity non-oscillating streams which project along spray axes defining a ring of sprays with a diameter which is substantially equal to the spout orifice diameter;

(e) and generating an oscillating spray having an oscillating spray transverse thickness, where the oscillating spray's transverse thickness is substantially equal to the spout orifice diameter, so that a compound flow is generated having an apparent outflow which has a spray density with an apparent outflow thickness which is substantially equal to or slightly larger than the spout orifice's diameter.

* * * * *